US005464720A

United States Patent [19]

Baba et al.

[11] Patent Number: 5,464,720

[45] Date of Patent: Nov. 7, 1995

[54] ELECTROPHOTOGRAPHIC METHOD AND APPARATUS USING MAGNETIC TONER

[75] Inventors: Yoshinobu Baba; Tatsuya Tada, both of Yokohama, Japan

[73] Assignee: Canon Kabushiki Kaisha, Tokyo, Japan

[21] Appl. No.: 59,993

[22] Filed: May 12, 1993

[30] Foreign Application Priority Data

May 13, 1992 [JP] Japan ..... 4-120708

[51] Int. Cl.[6] ..... G03G 13/09

[52] U.S. Cl. ..... 430/122; 430/106.6; 355/251

[58] Field of Search ..... 430/106.6, 122, 430/903; 355/251

[56] References Cited

U.S. PATENT DOCUMENTS

| | | | |
|---|---|---|---|
| 5,032,485 | 7/1991 | Kanbe et al. | 430/903 |
| 5,232,805 | 8/1993 | Misawa et al. | 430/903 |
| 5,239,342 | 8/1993 | Kubo et al. | 430/122 |
| 5,258,253 | 11/1993 | Fukumoto et al. | 430/106.6 |

FOREIGN PATENT DOCUMENTS

| | | |
|---|---|---|
| 56-102859 | 8/1981 | Japan . |
| 62-113159 | 5/1987 | Japan . |
| 63-113551 | 5/1988 | Japan . |

*Primary Examiner*—John Goodrow

*Attorney, Agent, or Firm*—Fitzpatrick, Cella, Harper & Scinto

[57] ABSTRACT

An image forming method is disclosed which comprises forming a latent image on a latent image bearing member, carrying a magnetic toner onto a developer carrying member provided with a magnetic field forming means, forming on the developer carrying member a layer of the magnetic toner, and developing the latent image while transferring the magnetic toner to the latent image bearing member. The magnetic toner contains a magnetic material having an intensity of magnetization of from 10 emu/g to 40 emu/g in a magnetic field of 1K oersted and formed of a metal oxide having a horizontal direction Feret's diameter of from 0.05 μm to 0.5 μm, and chainlike masses of the magnetic toner, formed on the developer carrying member, are in a density of not less than $8\times10^4$ ears/cm$^2$ in a developing zone formed between the latent image bearing member and developer carrying member. The chainlike masses each have a length of not more than 180 μm, and when the weight average particle diameter of the magnetic toner is r (μm) and the true density thereof is ρ (g/cm$^3$), the magnetic toner on the developer carrying member in the developing zone is in a quantity of not less than $0.06\times r\times\rho$ mg/cm$^2$. Also, an image forming apparatus is disclosed.

24 Claims, 6 Drawing Sheets

ELECTROPHOTOGRAPHIC METHOD AND APPARATUS USING MAGNETIC TONER

BACKGROUND OF THE INVENTION

1. Field of the Invention

The present invention relates to an image forming method for developing a latent image such as an electrostatically charged image, and an image forming apparatus.

2. Related Background Art

As dry developing in electrophotography, a process employing a one-component magnetic toner as a developer and a process employing a two-component developer comprised of a carrier and a toner are commonly in wide use. The two developing processes making use of the developer have respectively the following advantages, i.e., the advantages that in the one-component developing system the developing apparatus can be made small-sized and in the the two-component developing system the design tolerance can be set in a wide range because of its capability of sufficiently imparting electric charges to the toner.

The above advantages, however, are directed to compensation of problems involved in each other's system. As will be seen from this fact, the one-component system has the problem of a narrow range of design tolerance for the toner and developing system because of its tendency to an unsatisfactory process of imparting electric charges to the toner, and on the other hand the two-component system has the problem of a complicated construction of the apparatus because the toner and the carrier must be mixed in a concentration controlled to a constant value.

With regard to copied images obtained by the respective systems, in the case of the magnetic one-component system the development is carried out while the toner is formed into chains (commonly called "ears") under application of a magnetic field at the time of development, and hence the resolution of an image in the lateral direction tends to become poor compared with that in the longitudinal direction. For example, the phenomenon called "smeared image trailing edge" tends to occur which is due to the protrusion of ears to a non-image area of the latter half of a developed image, and also coarse images tend to occur compared with the two-component system. On the other hand, in the two-component system, a brush image trail of a magnetic brush tends to occur.

As stated above, a disadvantage of the magnetic one-component system is for one thing that the process of imparting electric charges tends to become unsatisfactory, and that the magnetic toner contains a magnetic material which may cause a lowering of image reproducibility.

As a method for settling the problem on image reproducibility, it can be considered effective to make the ears of a magnetic toner shorter and denser. As a means therefor, it can be readily expected to decrease the proportion of the amount of a magnetic material in the magnetic toner. Since, however, the existing developing system commonly depends on an absolute value of specific charges of magnetic toners, the magnetic toner in which the amount of a magnetic toner contained has been decreased tends to make it difficult to carry out development, for the following reasons.

When the radius of one particle of the magnetic toner is represented by R, the charge quantity by Q and the density by ρ, the specific charge Q/M of the magnetic toner is expressed as follows:

$$Q/M=3Q/4\pi\rho R^3$$

The density of a magnetic material in toner of commonly available magnetic toners is several times larger in its value than the density of a binder resin. Hence, the density ρ of the magnetic toner decreases with a decrease in the amount of a magnetic material in toner and the specific charge increases inversely. The increase in the specific charge tends to cause a decrease in image density. In particular, as is clear from the above expression, this tendency becomes more remarkable as toner particles are made to have a smaller particle diameter.

Image quality of copied images in the one-component magnetic developing system is greatly influenced by aggregation properties of magnetic toners, and faulty images such as fogging tend to occur as the aggregation properties become stronger. This phenomenon of fogging is understood to be due to ears each having become thick when magnetic toners have strong aggregation properties, which consequently make it difficult for magnetic toner particles present inside ears to be statically charged by friction with a developer carrying member, resulting in an insufficient electric charge of magnetic toner particles.

The relationship between the intensity of magnetization of magnetic toners and the shape of each ear is also understood qualitatively as follows: When the intensity of magnetizaiton of a magnetic toner is great, a strong attraction force in the direction of the magnetic field and a strong repulsion force in the direction perpendicular to the magnetic field act between magnetic toner particles. Hence, when the intensity of magnetizaiton is great, the ears formed by the magnetic toner become long and coarse and also each ear becomes slender. Inversely, when the intensity of magnetization of a magnetic toner is small, the ears become short and dense in turn and also each ear becomes thick and short because of no loosening of the combination between magnetic toner particles, resulting in an aggregated state. Hence, in the latter case, the magnetic toner particles present inside the ears tend to be insufficiently statically charged as previously stated.

Thus, an attempt to merely decrease the proportion of the amount of a magnetic material in the magnetic toner to make the ears shorter has brought about the problem that charge-up of the magnetic toners or deterioration of image quality such as fogging accompanied with faulty charging of the magnetic toner tends to occur.

In addition, since the magnetic material also serves as a colorant, merely decreasing the amount of the magnetic material may result in an insufficiency of image density.

As a method for making the ears of magnetic toners shorter and dense, one may contemplate the construction in which a developer layer thickness control member comprised of a resilient material is brought into contact with the developer carrying member. In such a construction, however, the developer layer thickness control member comprised of a resilient material tends to be abraded, bringing about the problem of a poor running stability.

Thus, as discussed above, it is earnestly sought to provide an image forming method, and an image forming apparatus, that can control the layer thickness of the developer on a developer carrying member in the state of non-contact with the developer carrying member, can make the intensity of magnetization of a magnetic toner smaller without decreasing the amount of a magnetic material in the magnetic toner, and can improve charging stability and image reproducibility.

SUMMARY OF THE INVENTION

An object of the present invention is to provide an image forming method and an image forming apparatus that have solved the above problems.

Another object of the present invention is to provide an image forming method and an image forming apparatus that can achieve a superior fine-line reproduction.

Still another object of the present invention is to provide an image forming method and an image forming apparatus that can form a toner image free from fog or having very little fog.

A further object of the present invention is to provide an image forming method and an image forming apparatus that can faithfully reproduce an original image.

The present invention provides an image forming method comprising;

forming a latent image on a latent image bearing member by a latent image forming means;

carrying a magnetic toner onto a developer carrying member provided with an internal magnetic field forming means;

forming on said developer carrying member a magnetic toner layer formed of the magnetic toner by means of a developer control member provided on said developer carrying member in a non-contact state; and developing the latent image while transferring said magnetic toner on the developer carrying member to said latent image bearing member to form a magnetic toner image on said latent image bearing member;

wherein;

said magnetic toner contains a magnetic material having an intensity of magnetization of from 10 emu/g to 40 emu/g in a magnetic field of 1K oersted and formed of a metal oxide having a horizontal direction Feret's diameter of from 0.05 μm to 0.5 μm;

chainlike masses of the magnetic toner, formed on said developer carrying member, are in a density of not less than $8\times10^4$ ears/cm$^2$ in a developing zone formed between said latent image bearing member and said developer carrying member;

the chainlike masses of said magnetic toner each have a length of not more than 180 μm; and when the weight average particle diameter of said magnetic toner is r (μm) and the true density thereof is ρ (g/cm$^3$), the magnetic toner on said developer carrying member in the developing zone is in a quantity of not less than $0.06\times r\times\rho$ mg/cm$^2$.

The present invention also provides an image forming apparatus comprising a latent image bearing member, a latent image forming means that forms a latent image on said latent image bearing member, a magnetic toner containing a magnetic material, a developer carrying member provided with an internal magnet its, a developer control member that controls the layer thickness of the developer on said developer carrying member, provided on said developer carrying member in a non-contact state, and a developing assembly that carries said magnetic toner on said developer carrying member and develops the latent image formed on said latent image bearing member to form a magnetic toner image on said latent image bearing member, wherein;

said magnetic toner contains a magnetic material having an intensity of magnetization of from 10 emu/g to 40 emu/g in a magnetic field of 1K oersted and formed of a metal oxide having a horizontal direction Feret's diameter of from 0.05 μm to 0.5 μm;

chainlike masses of the magnetic toner, formed on said developer carrying member, are in a density of not less than $8\times10^4$ ears/cm$^2$ in a developing zone formed between said latent image bearing member and said developer carrying member;

the chainlike masses of said magnetic toner each have a length of not more than 180 μm; and when the weight average particle diameter of said magnetic toner is r (μm) and the true density thereof is ρ (g/cm$^3$), the magnetic toner on said developer carrying member in the developing zone is in a quantity of not less than $0.06\times r\times\rho$ mg/cm$^2$.

DESCRIPTION OF THE PREFERRED EMBODIMENTS

Studies made by the present inventors have revealed that, in order to carry out good development, it is necessary to control the conditions such that chainlike masses of a magnetic toner (i.e., ears of a magnetic toner), formed on a developer carrying member, are in a density of not less than $8\times10^4$ ears/cm$^2$ in a developing zone formed between a latent image bearing member and the developer carrying member, the ears of the magnetic toner each have a length of not more than 180 μm and, when the weight average particle diameter of the magnetic toner is r (μm) and the true density thereof is ρ (g/cm$^3$), the magnetic toner on the developer carrying member in the developing zone is in a quantity of not less than $0.06\times r\times\rho$ mg/cm$^2$ so that charging stability and image reproducibility can be kept at a good level when the intensity of magnetization of a magnetic material contained in the magnetic toner is made smaller without decreasing the amount of the magnetic material in the magnetic toner.

Particularly preferably the ears may be in a density of not less than $10\times10^4$ ears/cm$^2$ and the ears of the magnetic toner may each have a length of not more than 160 μm. Providing control in this way has been found to be a condition for achieving stable and good image reproducibility.

Studies made by the present inventors have confirmed that the length of the ear of the magnetic toner, formed on the developer carrying member in the developing zone, and the intensity of magnetization are correlated as follows:

Length of ear ∝ Intensity of magnetization

In the present invention, the intensity of magnetization of the magnetic toner has been made smaller without decreasing the amount of the magnetic material in the magnetic-toner and also the process of imparting electric charges to the magnetic toner has been made stable to improve image reproducibility.

Figure 2:
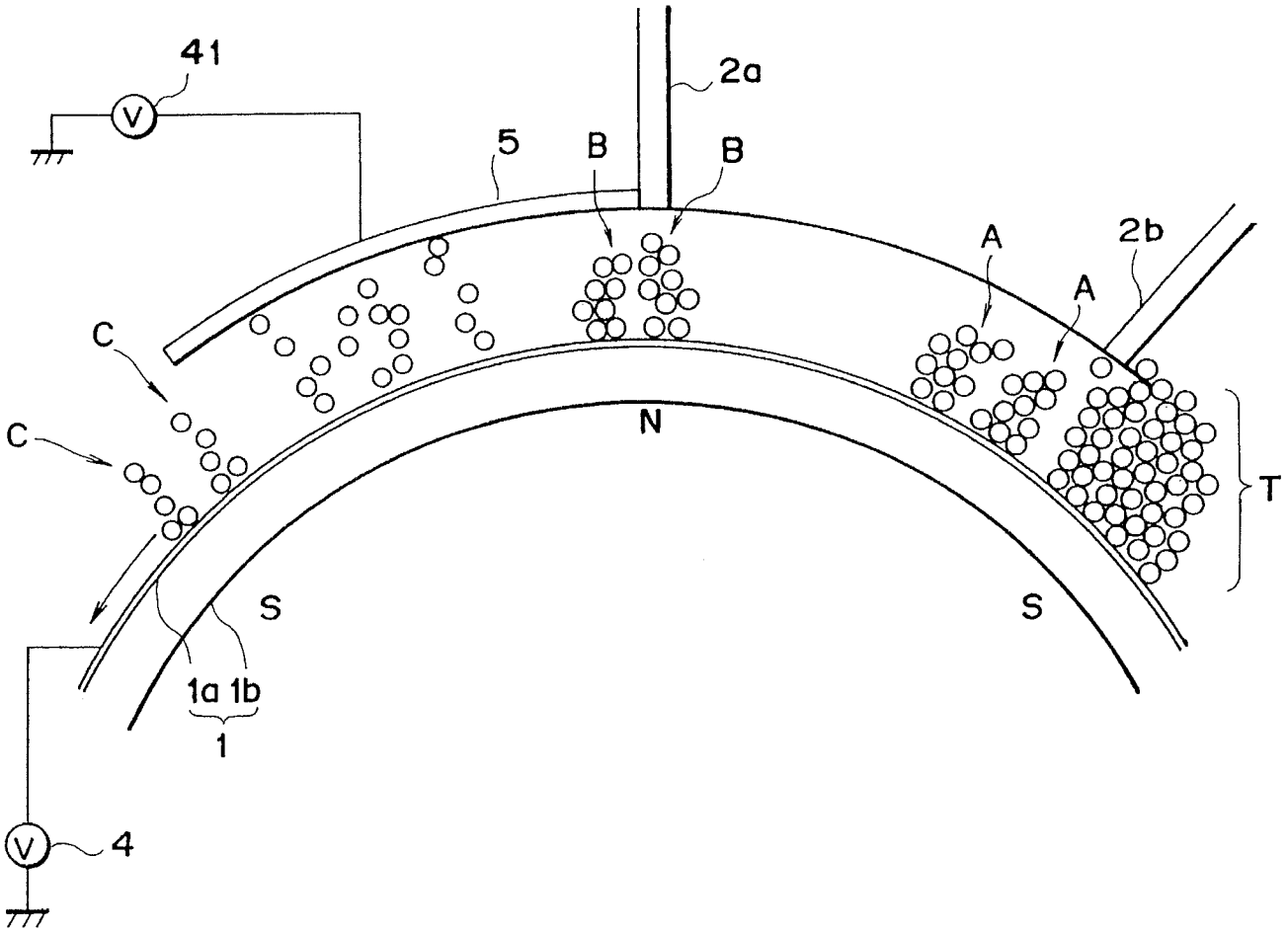
FIG. 2 illustrates how a magnetic toner behaves on and in the vicinity of the developer carrying member in the present invention.

The ear is defined as follows: On the basis of the weight average particle diameter r (μm) of the magnetic toner, a chainlike mass of magnetic toner present on the developer carrying member in its part upper by at least about 4 r (μm) in the developing zone of the developer carrying member is defined to be an ear (denoted by A, B or C in FIG. 2). The density of ears per unit area is defined to be the density of ears present on the developer carrying member in its part upper by about 4 r (μm) in the developing zone of the developer carrying member. The density of the ears is measured, for example, as follows: An optical microscope having been set to a 100× magnification level is focused on the developer carrying member at its position upper by about 4 r (μm) and the density of ears per unit area, present at that position is measured.

The length of the ear of the magnetic toner is measured, for example, as follows: An optical microscope is set to a 200× magnification level and in a state having a narrow depth of field. The focal point of the microscope is scanned upward from the developer carrying member until the tip of the ear is in focus, where the distance of movement of the focal point is measured as the length of the ear.

The constitution of the magnetic toner used in the present invention will be more detailed below. The magnetic material used in the present invention has an intensity of magnetization in the range of from 10 to 40 emu/g. It may preferably be from 20 to 40 emu/g. The intensity of a magnetic field of the magnetic material herein used is based on a value of a magnetic field of 1K oersted. The reason therefor is that, in the developing assembly used in the present invention, the magnetic field formed by a magnet provided inside the developer carrying member is a maximum of about 1K oersted at the surface of the developer carrying member and hence the intensity of magnetization in the magnetic field of 1K oersted is a value most suitable for taking account of magnetic properties of the magnetic toner in the developing assembly.

Magnetizing force is measured, for example, using VSM manufactured by Toei Kogyo K. K. If the intensity of magnetization in a magnetic field of 1K oersted is less than 10 emu/g, toner scatter may become problematic and also transport performance may become poor, making it difficult to obtain uniform and good images. If the intensity of magnetization is greater than 40 emu/g, the ears of the magnetic toner become so long that image reproducibility may become poor, often resulting in poor fine-line reproduction, gradation, etc. Coercive force may also concern image properties. The coercive force may be in the range of from 50 to 200 oersteds. The reason therefor is unclear. If the coercive force is less than 50 oersteds, fog in background areas tends to occur. If the coercive force is more than 200 oersteds, transport performance may become poor, resulting in a poor coating performance to make image quality poor to cause, e.g., uneven image density.

Particle diameter of the magnetic material concerns charge quantity, coloring power and so forth of the toner. The particle diameter of the magnetic material is indicated by horizontal direction Feret's diameter. It is measured, for example, as follows: A photograph of the magnetic material magnified 10,000 times, taken with a transmission electron microscope, is enlarged by 4× magnifications to make a photograph of 40,000× magnifications. Thereafter, 250 magnetic material particles are selected at random and their diameters are actually measured to determine an average particle diameter. The average particle diameter ranges from 0.05 to 0.5 μm, preferably from 0.08 to 0.4 μm, and more preferably from 0.1 to 0.4 μm. If the average particle diameter is less than 0.05 μm, it is difficult to control charging and also the magnetic material tends to be oxidized, tending to result in a poor handling performance. If the average particle diameter is larger than 0.5 μm, coloring power can be insufficient and also the toner may be non-uniformly charged, often tending to cause fog in background areas.

The magnetic material may be in a content (% by weight) of from 30 to 60% by weight. Its use in a content less than 30% by weight may make transport performance unsatisfactory to cause uneven image density or make it hard for the aggregation of ears to loosen, bringing about the problem of occurrence of fog in background areas. Its use in a content more than 60% by weight may make the present invention less effective, bringing about the problem of a poor image reproducibility.

According to the studies made by the present inventors, when the weight average particle diameter r of the toner is $r \leqq 7.5$, the magnetic material may be in a content (WT) within the range of;

$$\{WT=-(10/3)r+(70\pm15)\}$$

This is a preferable condition for preventing the problems arising from the transport performance, aggregation, etc.

Good images cannot be obtained unless the toner is also in a proper charge quantity (triboelectricity). The charge quantity of the toner is measured, for example, by the blow-off method. As a measuring device, it is possible to use, for example, a device manufactured by Toshiba Chemical Corporation.

In the measurement, for example, an iron powder EFV200/300 (available from Nihon Teppun K. K.) is used as a carrier. The toner and the carrier are blended for about 2 minutes in a toner concentration of 2% by weight. A value thus measured may be 5 to 50 μc/g as an absolute value, and preferably 5 to 40 μc/g. If it is less than 5 μc/g, images may have a poor sharpness and fog in background areas tends to occur. Moreover, in an environment of high temperature and high humidity, a decrease in image density tends to become problematic. If it is larger than 50 μc/g, static aggregation force may become so large that the ears can loosen with difficulty, tending to cause a lowering of image quality. In particular, in an environment of low temperature and low humidity, the mirror image force against a toner carrying member become unnecessarily large to tend to cause, e.g., a decrease in image density.

The particle diameter of the toner of the present invention is measured, for example, using Coulter Counter, Type TA-II, manufactured by Coulter Electronics Inc. A 100 μm aperture is used as its aperture. Particle size is calculated as weight average particle diameter, and variation coefficient is calculated by dividing standard deviation of volume distribution by volume average diameter and multiplying the resulting value by 100.

A binder resin for the toner may include homopolymers of styrene or derivatives thereof and copolymers thereof such as polystyrene, poly-p-chlorostyrene, polyvinyltoluene, a styrene/p-chlorostyrene copolymer and a styrene/vinyltoluene copolymer; copolymers of styfane with acrylates such as a styfane/methyl acrylate copolymer, a styfane/ethyl acrylate copolymer and a styrene/n-butyl acrylate copolymer;

copolymers of styfane with methacrylates such as a styfane/methyl methacrylate copolymer, a styfane/ethyl methacrylate copolymer and a styrene/n-butyl methacrylate copolymer; terpolymers of styrene with acrylates and methacrylates; copolymers of styfane with other vinyl monomers such as a styrene/acrylonitrile copolymer, a styrene/methyl vinyl ether copolymer, a styrene/butadiene copolymer, a styrene/methyl vinyl ketone copolymer, a styrene/acrylonitrile/indene copolymer and a styrene/maleate copolymer; polymethyl methacrylate, polybutyl methacrylate, polyvinyl acetate, polyester, polyamide, epoxy resins, polyvinyl butyral, polyacrylic acid, phenol resins, aliphatic or alicyclic hydrocarbon resins, petroleum resins, and chlorinated paraffin, any of which can be used alone or in combination.

In particular, a binder resin for toners applied in pressure fixing systems may include low-molecular weight polyethylene, low-molecular weight polypropylene, an ethylene/vinyl acetate copolymer, an ethylene/acrylate copolymer, higher fatty acids, polyamide resins and polyester resins. These may be used alone or in the form of a mixture.

The polymer, copolymer or polymer blend used can bring about more preferable results when it contains a vinyl aromatic type or acrylic type monomer as typified by styrene in an amount of not less than 40% by weight.

In the toner, any suitable pigment or dye may be used as a colorant. For example, the colorant may include known dyes or pigments such as carbon black, Phthalocyanine Blue, ultramarine blue, quinacridone and Benzidine Yellow.

The toner containing the magnetic material used in the present invention may be prepared by conventionally known methods. For example, the binder resin, a charge control agent, the colorant, the magnetic material and other additives are previously subjected to powder mixing using a Henschel mixer or the like. Then the resulting mixture is kneaded for about 30 minutes in a roll mill heated to about 150° C. to give a kneaded product. The kneaded product is cooled, followed by pulverization and optionally classification to give a toner composition.

If necessary, a fluidity-providing agent, a lubricant, an abrasive, a cleaning aid, a resistance modifier, a charge control agent, etc. may be internally or externally added.

The present invention will be described below in greater detail by giving Examples. These by no means limit the present invention. Magnetic materials used in the following Examples and Comparative Examples are shown in Table 1.

TABLE 1

| Magnetic material No. | Composition Zn % | Mn % | FeO % | Feret's diameter μm | BET $m^2/g$ | Magnetic characteristics 1 KOe σs emu/g | σr emu/g | Hc Oe |
|---|---|---|---|---|---|---|---|---|
| 1 | 18 | — | 9 | 0.25 | 8.8 | 31.5 | 5.7 | 170 |
| 2 | 20 | — | 7 | 0.2 | 9.4 | 37.8 | 6.4 | 78 |
| 3 | — | — | 25 | 0.42 | 5.5 | 56.0 | 10.0 | 110 |

EXAMPLE 1

An embodiment according to the present invention will be described below with reference to the drawings.

Figure 1:
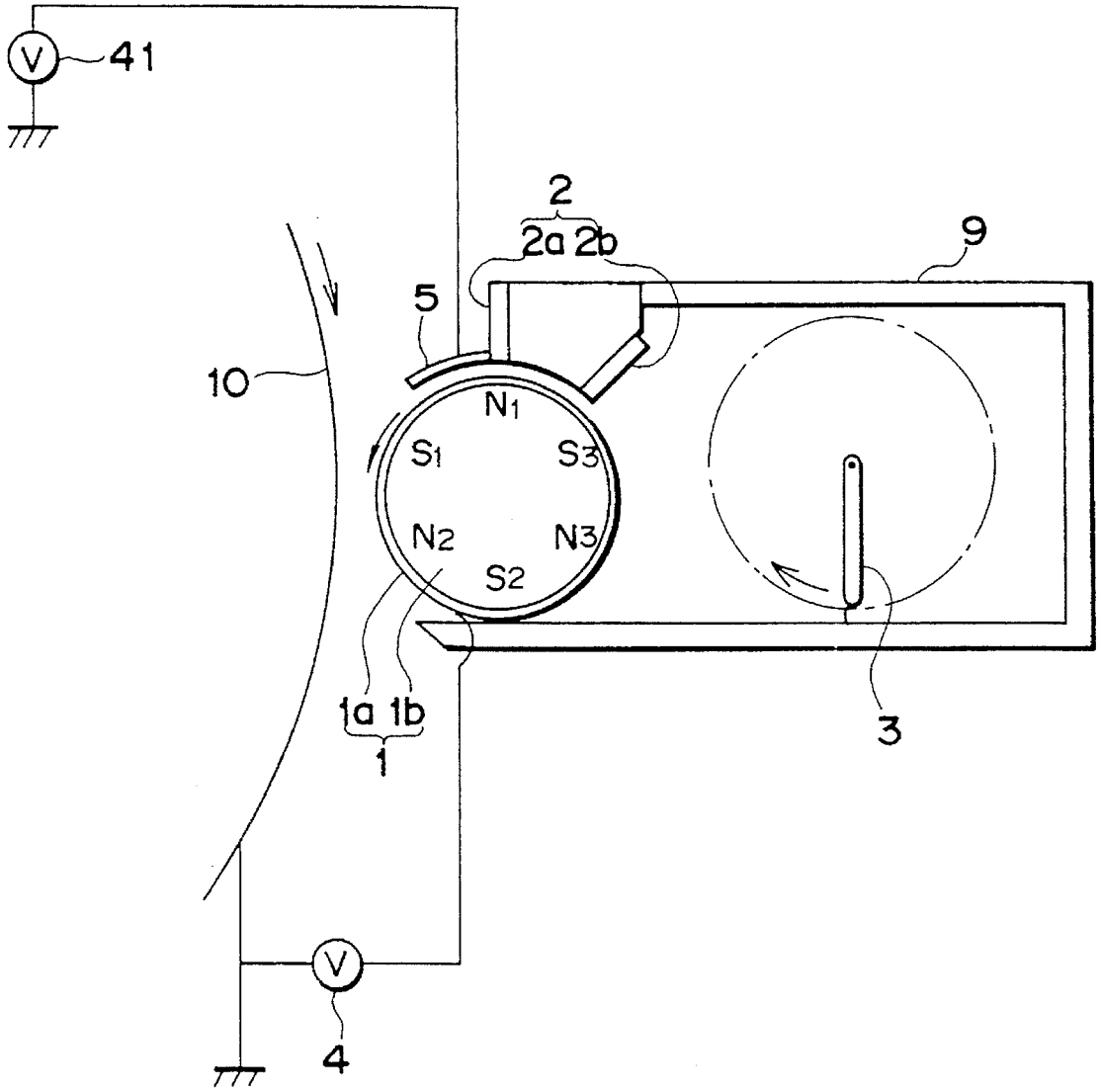
FIG. 1 illustrates a schematic cross section of a developing assembly according to an embodiment of the present invention.

FIG. 1 is a schematic cross section of a developing assembly according to an embodiment of the present invention. In FIG. 1, reference numeral 1*a* denotes a developing sleeve made of a non-magnetic metal, which is a developer carrying member rotatable in the direction of an arrow; 1*b*, a permanent magnet provided inside the developing sleeve 1*a*; and 2*a* and 2*b*, magnetic blades (developer control members) made of magnetic members and capable of controlling the quantity of the developer carried on the developer carrying member. In the present invention, the magnetic blades are provided in plurality in the state of non-contact with the developer carrying member. Herein, the state of non-contact means that the developer carrying member and the developer control members are provided in a non-contact state when the developer is not held between the developer carrying member and the developer control members. Reference numeral 9 denotes a developer container; and 3, a transport member for transporting the magnetic toner in the developer container 9 toward the developing sleeve 1*a*. Reference numeral 5 denotes an electrode provided opposingly and adjacently to the developing sleeve 1*a*; 4, a power source for applying a developing bias to the developing sleeve; and 41, a power source for applying an alternating electric field across the developing sleeve and the electrode 5.

According to the developing assembly constructed as described above, as shown in FIG. 2, the magnetic toner, designated by T, is transported on the developing sleeve la in the direction of an arrow, and is controlled to have the desired toner layer thickness when it passes through a gap between the developer control member 2*b* and the developing sleeve 1*a* (a layer thickness control zone). The toner T having passed through the layer thickness control zone forms ears A. When it passes through the layer thickness control zone, among toner particles that form the ears A, toner particles having had the position of contact with the developing sleeve 1*a* and the magnetic blade 2*b* gain electrostatic charges generated triboelectrically. Hence, according to this type of the layer thickness control system, a toner thus triboelectrically charged and a toner not triboelectrically charged are present together in the ears A having passed through the developer control member. In particular, in the case of the magnetic toner used in the present invention, containing therein the magnetic material having the intensity of magnetization in the range described above, the repulsion force acting between toner particles on account of a magnetic force is considered to be smaller than the aggregation force acting between magnetic toner particles, and hence the ears A each become thick, so that a number of toner particles not triboelectrically charged are present in the ears A.

Studies made by the present inventors have revealed that the repulsion force acting between toner particles on account of a magnetic force becomes larger in the portion at which magnetic lines of force are concentrated. Thus, the present invention takes the construction, which is a characteristic feature of the present invention, that the magnetic blade 2*a* is provided so that the magnetic lines of force can be concentrated between the magnetic blade 2*a* and the developing sleeve la to make the ears A become loose. Because of such construction, the ears A are loosened and each become slender as shown by ears B, and hence surfaces of many of toner particles come to be partly exposed to the surfaces of the ears B.

The present invention also takes the construction that, after the ears B have been made loose by the developer control member 2*a*, an electrode 5, which is a characteristic feature of the present invention, is further provided opposingly to the developing sleeve 1*a* and also the construction that an alternating electric field is applied across the both so that the ears B are vibrated between electrodes. Thus, it becomes possible for the toner particles at the surfaces of the ears B, exposed to the surfaces of the ears B when they passed through the magnetic blade 2a, to come into contact with the developing sleeve 1a during the vibration. It also becomes possible for the ears B to become loose from their aggregation during its vibration between the electrodes, and for the toner having become loose to come into contact with the developing sleeve la during the vibration. Hence, ears C formed after the ears B have passed through the electrodes each become more slender than the ears A, and the percentage of the toner particles not triboelectrically charged in the ears C becomes smaller than the percentage in the ears A.

In the present invention, the gap between the developing sleeve 1a and the electrode 5 has been set at about 300 μm, and the gap between the developing sleeve 1a and the developer control members 2a and 2b also at about 300 μm.

In the construction of the present invention, a developing bias is applied to the developing sleeve 1a through the power source 4, and the developing bias is applied as an alternating rectangular wave bias of Vpp 1,800 V and a frequency of 2,000 Hz.

In the construction of the present invention, the alternating electric field to be applied between the developing sleeve 1a and the electrode 5 through the power source 41 is applied as an alternating rectangular wave bias of Vpp 2,000 V and a frequency of 2,000 Hz.

In the construction of the present invention, the magnetic poles of the permanent magnet 1b provided inside the developing sleeve 1a are so arranged as to be in the vicinity of the developer control members 2a and 2b, and the magnetic poles arranged in the vicinity of the developer control members 2a and 2b may each preferably have a magnetic flux density of 600 G or more. In the present construction, they are each set to have a magnetic flux density of 800 G.

The magnetic toner used in the present invention is so made up as to have a smaller intensity of magnetization of the magnetic toner without decreasing the amount of the magnetic material in the magnetic toner. A magnetic material having an intensity of magnetization of from 10 emu/g to 40 emu/g in a magnetic field of 1K oersted is used, which generally has a smaller intensity of magnetization than magnetic materials usually used. The magnetic material contained in the magnetic toner may include metal oxides containing an element such as iron, cobalt, nickel, copper, magnesium, manganese, aluminum or silicon.

The magnetic material in the magnetic toner of the present invention, used in the present Example, is the magnetic material No. 1, which is a spinal iron oxide obtained by the synthesis method as described below.

SYNTHESIS EXAMPLE

A bubble oxidation type reaction column with an internal volume of 180 liters was used as a reactor. Industrial iron sulfate was dissolved in water to prepare 40 liters of a solution with a ferrous concentration of 134 g/liter. Separately, 40 liters of a solution of sodium hydroxide with a concentration of 182 g/liter was prepared, to which the above iron sulfate solution was added with stirring to effect neutralization so that the remaining sodium hydroxide was in a concentration of 5 g/liter. To the resulting solution, 50 liters of a solution of industrial zinc hydroxide with a pH of 11.3 and a zinc concentration of 40 g/liter was added to prepare a reaction mixture with a ferrous concentration of 40 g/liter. While maintaining the temperature of the reaction mixture at 80° C., oxidizing air was blown at a rate of 10 liters/mm to carry out oxidation reaction. The reaction was completed in about 7 hours. Subsequently the resulting slurry was washed and dried. Thus a spinal iron oxide was obtained. The magnetic material thus obtained had a horizontal direction Feret's diameter of 0.25 μm, a BET specific surface area of 8.8 $m^2/g$, an intensity of magnetization of 31.5 emu/g, a coercive force of 170 oersteds and a residual magnetization of 5.7 emu/g.

The magnetic toner was produced in the following way.

| | |
|---|---|
| Styrene/acrylate copolymer | 54.9% by weight |
| Negative charge control agent | 0.5% by weight |
| Magnetic material (the magnetic material obtained in the above Synthesis Example) | 44.4% by weight |
| Release agent | 0.2% by weight |

The above materials were mixed, and the resulting mixture was heat-kneaded for about 30 minutes using a twin-roll mill set at 140° C., and the kneaded product was cooled, followed by crushing and then pulverization (jet milling). Then the pulverized product was classified using an elbow jet classifier to cut fine powder and coarse powder. The magnetic toner was thus obtained. The magnetic toner obtained had a particle size of a weight average particle diameter of 8.5 μm and a variation coefficient of 30%. To the resulting toner, 0.6% by weight of negatively chargeable colloidal silica was externally added to give a one-component developer comprised of a magnetic toner having negatively chargeable colloidal silica on magnetic toner particle surfaces.

According to the construction of the present Example, the developer (magnetic toner) on the developer carrying member in the developing zone was in a quantity of 0.8 to 1.0 $mg/cm^2$ per unit area, the chainlike masses (i.e., the ears) of the magnetic toner, formed on the developer carrying member, were in a density of $8\times10^4$ to $15\times10^4$ $ears/cm^2$ in the developing zone formed between the latent image bearing member 10 and the developer carrying member 1a, and the chainlike masses of the magnetic toner had a length of not more than 160 μm. Under these conditions, the magnetic toner was stably statically charged and also image reproducibility was good.

The magnetic toner used in the present invention is by no means limited to the one used in the present Example, so long as it is the magnetic toner having an intensity of magnetizaiton of from 10 emu/g to 40 emu/g in a magnetic field of 1K oersted and having a horizontal direction Feret's diameter of from 0.05 μm to 0.5 μm.

The gap between the developer control members 2a and 2b and the developing sleeve 1a used in the present invention is by no means limited to the above construction, so long as it is 50 to 1,000 μm. The gap between the developing sleeve la and the electrode 5 may also be in such an extent that the ears formed by the magnetic toner can vibrate plural times in response to the electric field, between the electrodes formed between the electrode 5 and the developing sleeve 1a, and no leak of voltage may occur between the electrodes. It may preferably be in the range of from 100 to 2,500 μm.

The Vpp and frequency of the alternating voltage applied to the opposing electrode 5 are also by no means limited to those in the present Example, and the voltage may preferably be applied in such a degree that the ears formed by the magnetic toner can vibrate plural times in response to the electric field, between the electrodes formed between the electrode 5 and the developing sleeve 1*a*, and no leak of voltage may occur between the electrodes. For example, the Vpp may be in the range of from 100 V to 3,000 V, and may preferably in the range of from 500 V to 2,500 V. The frequency may be in the range of from 1,000 Hz to 10,000 Hz, and may preferably be in the range of from 2,000 Hz to 8,000 Hz. A direct current bias voltage may also be overlapped. The range of the overlapping direct current voltage depends on the Vpp applied, and may approximately be 1,000 V or below as an absolute value.

Because of the above construction, the intensity of magnetization of the magnetic toner has been made smaller without decreasing the amount of the magnetic material in the magnetic toner and also the process of imparting electric charges to the magnetic toner has been made stable to improve image reproducibility.

COMPARATIVE EXAMPLE 1

A magnetic toner was produced in the same manner as in Example 1 except that the magnetic material used therein was replaced with the magnetic material No. 3. The magnetic toner thus obtained had a particle size of a weight average particle diameter of 8.3 μm and a variation coefficient of 35%.

Figure 6:
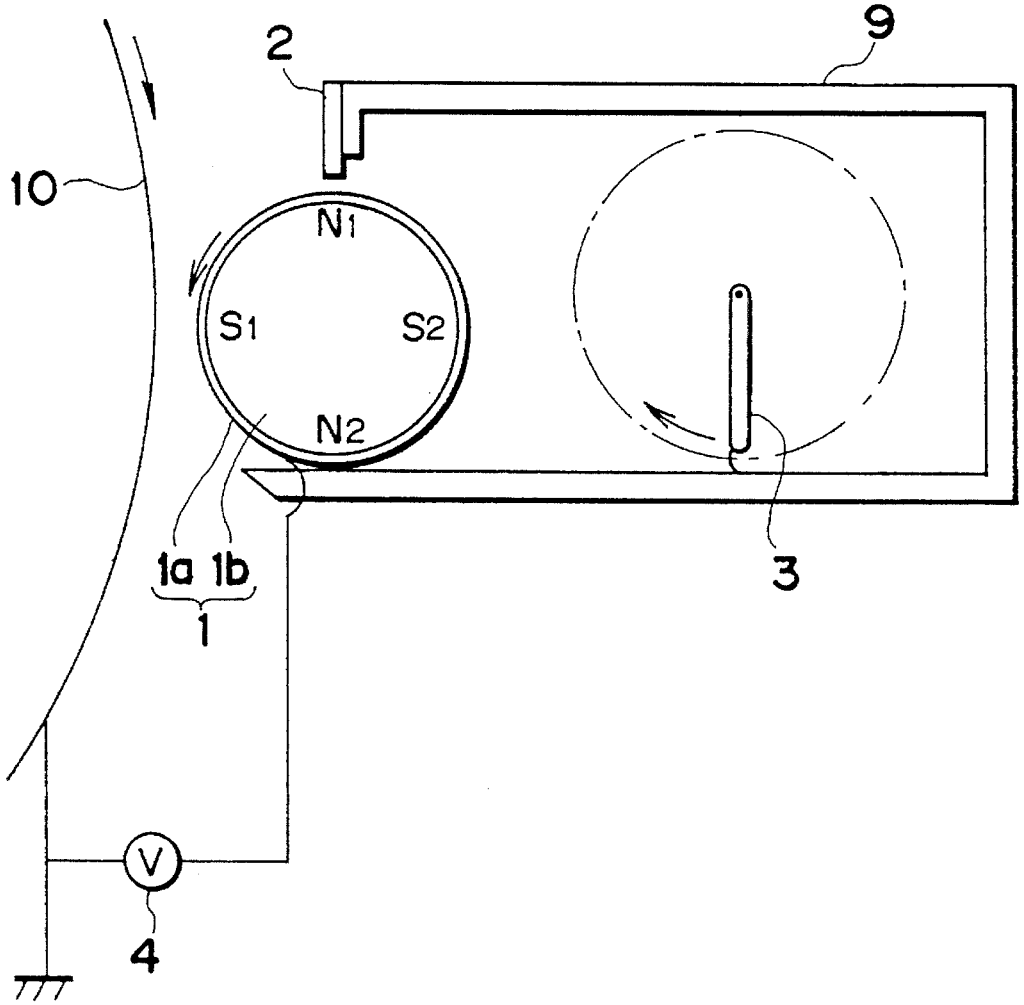
FIG. 6 illustrates a schematic cross section of a developing assembly of Comparative Example.

This magnetic toner was applied to the developing assembly shown in FIG. 6. In FIG. 6, reference numeral la denotes a developing sleeve made of a non-magnetic metal, which is a developer carrying member rotatable in the direction of an arrow; 1*b*, a permanent magnet provided inside the developing sleeve 1*a*; 2, a magnetic blade made of a magnetic member, provided in the state of non-contact with the developer carrying member, and capable of controlling the quantity of the developer carried on the developer carrying member; 9, a developer container; 3, a transport member for transporting the magnetic toner in the developer container 9 toward the developing sleeve 1*a*; and 4, a power source for applying a developing bias to the developing sleeve. Using the developing assembly thus constructed, evaluation was made to confirm that the fine-line reproduction could not be said to be faithful to the latent image, compared with that in Example 1.

The developer on the developer carrying member in the developing zone was in a quantity of 0.8 to 1.0 mg/cm$^2$ per unit area, the ears of the magnetic toner were in a density of $5\times10^4$ to $7\times10^4$ ears/cm$^2$ in the developing zone formed between the latent image bearing member and the developer carrying member, and the ears had a length of from 200 to 220 μm.

Here, the permanent magnet 1*b* provided in the developing assembly shown in FIG. 6 was comprised of a permanent magnet whose magnetic poles arranged in the vicinity of the developing zone had a magnetic flux density of 800 G or more on the developing sleeve 1*a*.

COMPARATIVE EXAMPLE 2

In the developing assembly shown in FIG. 6, the magnetic toner of Example 1 was evaluated to confirm that image fog due to faulty charging of the magnetic material occurred.

The developer on the developer carrying member in the developing zone was in a quantity of 0.8 to 1.0 mg/cm$^2$ per unit area and the ears had a length of 160 μm or less, but the ears of the magnetic toner were in a density of $5\times10^4$ to $7\times10^4$ ears/cm$^2$ in the developing zone formed between the latent image bearing member and the developer carrying member.

EXAMPLE 2

The present invention is by no means limited to the magnetic toner of Example 1. A magnetic material was prepared in the same manner as Synthesis Example in Example 1 to give the magnetic material No. 2, a spinal iron oxide. The magnetic material thus obtained had a horizontal direction Feret's diameter of 0.20 μm, a BET specific surface area of 9.4 m$^2$/g, an intensity of magnetization of 37.8 emu/g, a coercive force of 78 oersteds and a residual magnetization of 6.4 emu/g. Using this magnetic material, a toner was produced. Its formulation was as follows:

| | |
|---|---|
| Styrene/acrylate copolymer | 49.7% by weight |
| Negative charge control agent | 0.5% by weight |
| Magnetic material (the above magnetic material) | 49.6% by weight |
| Release agent | 0.2% by weight |

agent 0.2% by weight

The magnetic toner thus obtained had a weight average particle diameter of 6.1 μm and a variation coefficient of 34%. To the resulting toner, 0.9% by weight of negatively chargeable colloidal silica was externally added to give a one-component developer. This magnetic toner having the silica externally added and the developing assembly of Example 1 were put into use. As a result, the developer on the developer carrying member in the developing zone was in a quantity of 0.63 to 0.85 mg/cm$^2$ per unit area, the chainlike masses (the ears) of the magnetic toner, formed on the developer carrying member, were in a density of $10\times10^4$ to $18\times10^4$ ears/cm$^2$ in the developing zone formed between the latent image bearing member and the developer carrying member, and the chainlike masses of the magnetic toner had a length of not more than 140 μm. Under these conditions, the magnetic toner was stably statically charged and also image reproducibility was good.

EXAMPLE 3

Figure 3:
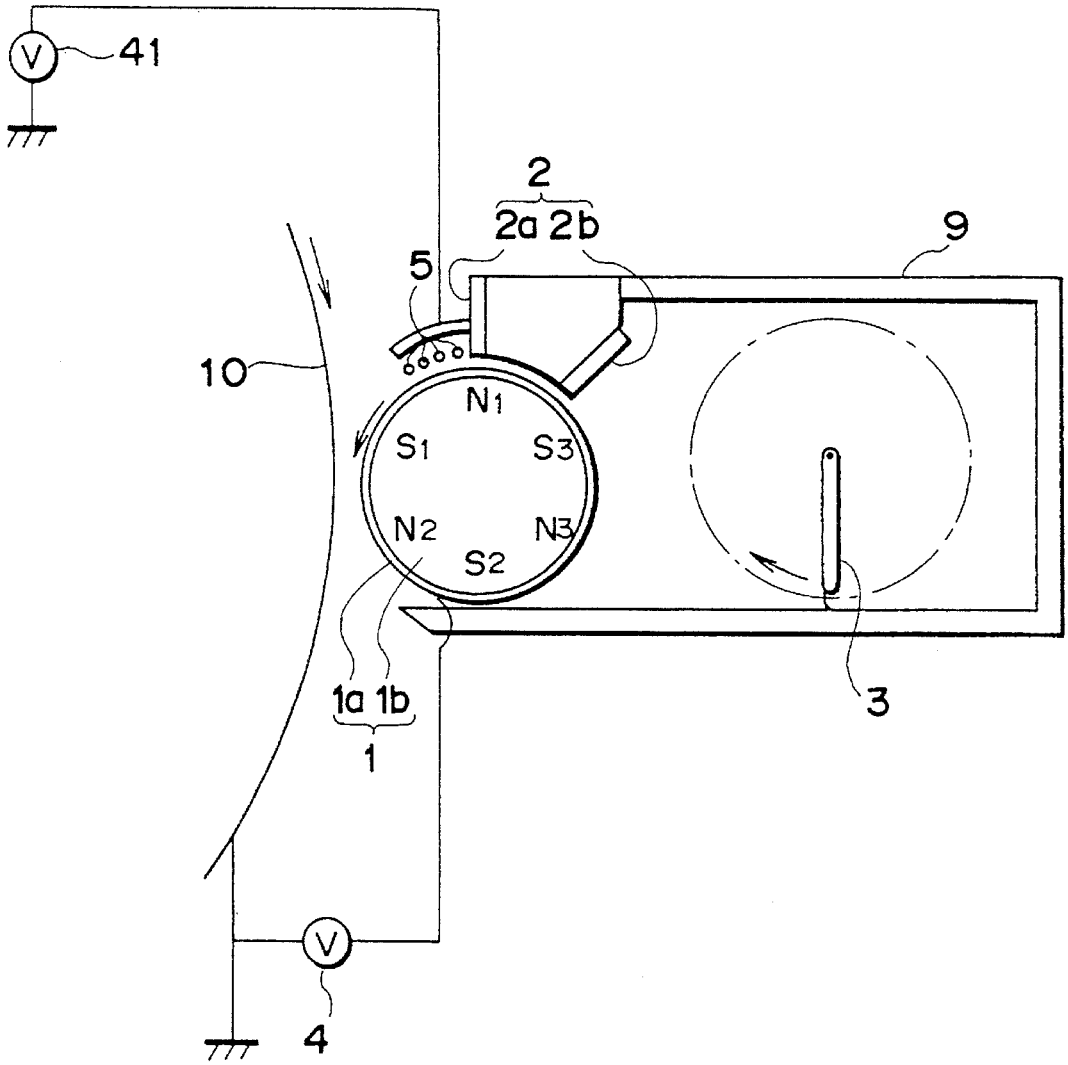
FIG. 3 illustrates a schematic cross section of a developing assembly according to an embodiment of the present invention in which electrodes are in the form of wires.

The present invention is by no means limited to the construction in the above Examples. The electrode provided opposingly and adjacently to the developing sleeve 1*a* may be comprised of a wirelike electrode 5 as shown in FIG. 3.

In this case, the wirelike electrode is not necessarily single and may be arranged in plurality.

Use of the developing assembly thus constructed and the magnetic toner of Example 1 made it possible to stably statically charge the magnetic toner and to improve image reproducibility.

EXAMPLE 4

Figure 4:
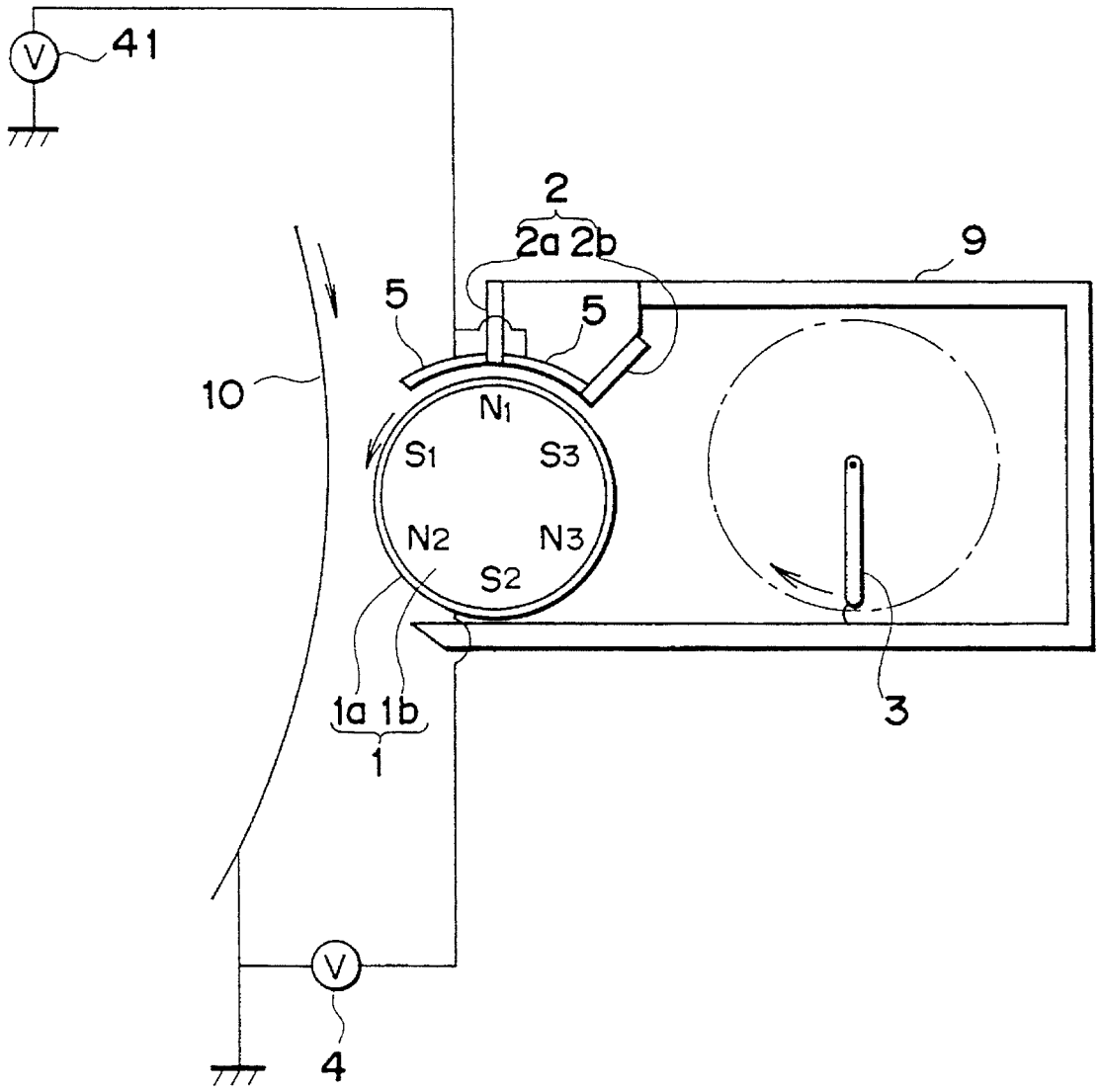
FIG. 4 illustrates a schematic cross section of a developing assembly according to an embodiment of the present invention in which electrodes are provided at upstream and downstream positions of the direction of rotation of the developer carrying member with respect to the developer control member.

The present invention is by no means limited to the construction in the above Examples. The electrode provided opposingly and adjacently to the developing sleeve la may be disposed, as shown in FIG. 4, at not only an upstream position but also a downstream position of the direction of rotation of the developing sleeve la relative to the developer control member 2*a*.

Use of the developing assembly thus constructed and the magnetic toner of Example 1 made it possible to stably statically charge the magnetic toner and to improve image reproducibility.

EXAMPLE 5

Figure 5:
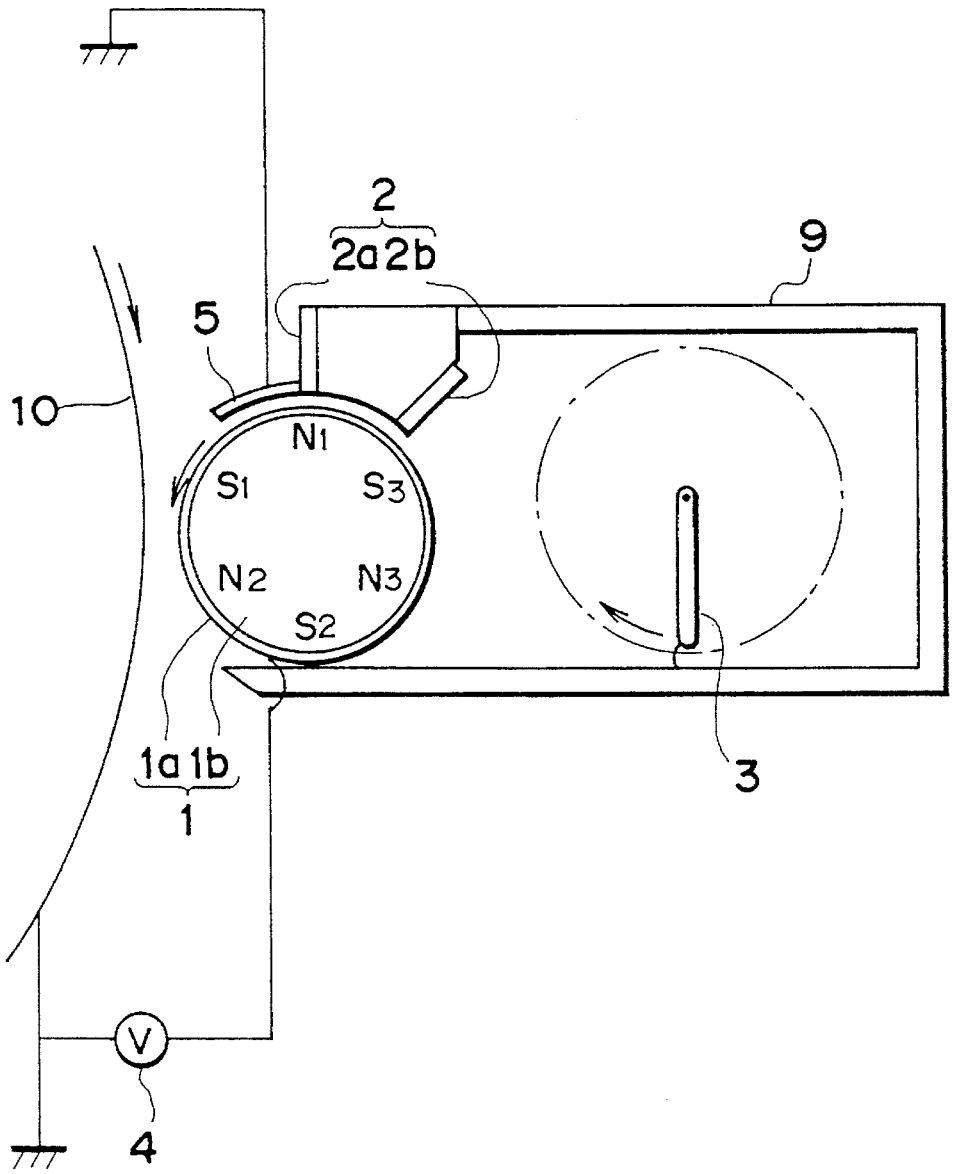
FIG. 5 illustrates a schematic cross section of a developing assembly according to an embodiment of the present invention in which a power source that applies an electric field across the developer carrying member and an electrode, and a developing bias power source are set as a common power source.

In the present invention, as shown in FIG. 5, the alternating electric field may be applied across the developing sleeve 1*a* and the opposing electrode 5 by a method in which the electrode 5 is grounded so that an alternating electric field equivalent to the developing bias can be applied across the electrodes.

Use of the developing assembly thus constructed and the magnetic toner of Example 1 made it possible to stably statically charge the magnetic toner and to improve image reproducibility.

According to the present invention constructed as described above, it becomes possible to make the intensity of magnetization of a magnetic one-component toner smaller and also make the process of imparting electric charges to the toner stable, so that the development carried out using the magnetic one-component toner can enjoy an improved image reproducibility.

What is claimed is:

1. An image forming method comprising:

forming a latent image on a latent image bearing member by a latent image forming means;

carrying a magnetic toner onto a developer carrying member provided with an internal magnetic field forming means;

forming on said developer carrying member a magnetic toner layer formed of the magnetic toner by means of a developer control member provided on said developer carrying member in a non-contact state;

vibrating the magnetic toner layer on the developer carrying member by means of an electrode; and developing the latent image while transferring said vibrated magnetic toner on the developer carrying member to said latent image bearing member to form a magnetic toner image on said latent image bearing member;

wherein said magnetic toner contains a magnetic material having an intensity of magnetization of from 10 emu/g to 40 emu/g in a magnetic field of 1K oersted and a horizontal direction Feret's diameter of from 0.05 μm to 0.5 μm, and said magnetic material is formed of a metal oxide;

chainlike masses of the magnetic toner, formed on said developer carrying member, are in a density of not less than $8\times10^4$ ears/cm$^2$ in a developing zone formed between said latent image bearing member and said developer carrying member;

the chainlike masses of said magnetic toner each have a length of not more than 180 μm; and when the weight average particle diameter of said magnetic toner is r (μm) and the true density thereof is ρ (g/cm$^3$), the magnetic toner on said developer carrying member in the developing zone is in a quantity of not less than $0.06\times r\times\rho$ mg/cm$^2$.

2. The image forming method according to claim 1, wherein said magnetic toner contains the magnetic material in an amount of from 30% by weight to 60% by weight.

3. The image forming method according to claim 1, wherein said magnetic toner satisfies the conditions:

$$WT = -(10/3)r + (70 \pm 15),$$

$$r \leqq 7.5$$

wherein WT represents a content (% by weight) of the magnetic material in the magnetic toner, and r represents a weight average particle diameter (μm) of the magnetic toner.

4. The image forming method according to claim 1, wherein said chainlike masses of the magnetic toner on the developer carrying member are controlled by a chainlike-mass control means that is in non-contact with said developer carrying member and makes said chainlike masses slender.

5. The image forming method according to claim 1, wherein said chainlike masses of the magnetic toner are controlled at least twice by a chainlike-mass control means.

6. The image forming method according to claim 1, wherein at least two chainlike-mass control means are provided, at least one of which has an electrode set oppositely to said developer carrying member, provided in a state of non-contact with the developer carrying member in order to apply an alternating electric field to the vicinity of the developer control member, and the alternating electric field is applied across said developer carrying member and said electrode.

7. The image forming method according to claim 1, wherein said magnetic material has an intensity of magnetization of from 20 emu/g to 40 emu/g.

8. The image forming method according to claim 1, wherein said magnetic material has a coercive force of from 50 oersteds to 200 oersteds.

9. The image forming method according to claim 1, wherein said magnetic material has an average particle diameter of from 0.05 μm to 0.5 μm.

10. The image forming method according to claim 1, wherein said magnetic material has an average particle diameter of from 0.08 μm to 0.4 μm.

11. The image forming method according to claim 1, wherein said magnetic material has an average particle diameter of from 0.1 μm to 0.4 μm.

12. The image forming method according to claim 1, wherein said magnetic toner has a triboelectricity of from 5 μc/g to 50 μc/g.

13. The image forming method according to claim 1, wherein said magnetic toner has a triboelectricity of from 5 μC/g to 40 μc/g.

14. The image forming method according to claim 6, wherein an alternating electric field of a Vpp of from 100 V to 3,000 V is applied to said opposing electrode.

15. The image forming method according to claim 6, wherein an alternating electric field of a Vpp of from 500 V to 2,500 V is applied to said opposing electrode.

16. The image forming method according to claim 14, wherein an alternating electric field of a frequency of from 1,000 Hz to 10,000 Hz is applied to said opposing electrode.

17. The image forming method according to claim 15, wherein an alternating electric field of a frequency of from 2,000 Hz to 8,000 Hz is applied to said opposing electrode.

18. An image forming apparatus comprising:

a latent image bearing member;

a latent image forming means that forms a latent image on said latent image bearing member;

a magnetic toner containing a magnetic material, a developer carrying member provided with an internal magnet;

a developer control member that controls the layer thickness of the magnetic toner on said developer carrying member, provided on said developer carrying member in a non-contact state, an electrode for vibrating said magnetic toner layer on the developer carrying member and a developing assembly that carries said magnetic toner provided on said developer carrying member and develops the latent image formed on said latent image bearing member to form a magnetic toner image on said latent image bearing member;

wherein said magnetic toner contains a magnetic material having an intensity of magnetization of from 10 emu/g to 40 emu/g in a magnetic filed of 1K oersted and a horizontal direction of Feret's diameter of from 0.05 μm to 0.5 μm, and said magnetic material is formed of a metal oxide;

chainlike masses of the magnetic toner, formed on said developer carrying member, are in a density of not less than $8\times10^4$ ears/cm$^2$ in a developing zone formed between said latent image bearing member and said developer carrying member;

the chainlike masses of said magnetic toner each have a length of not more than 180 μm; and when the weight average particle diameter of said magnetic toner is r (μm) and the true density thereof is ρ (g/cm$^3$), the magnetic toner on said developer carrying member in the developing zone is in a quantity of not less than $0.06\times r\times\rho$ mg/cm$^2$.

19. The image forming apparatus according to claim 18, wherein said magnetic toner contains the magnetic material in an amount of from 30% by weight to 60% by weight.

20. The image forming apparatus according to claim 18, wherein said magnetic toner satisfies the conditions:

$$WT = -(10/3)r + (70 \pm 15),$$

$$r \leqq 7.5$$

wherein WT represents a content (% by weight) of the magnetic material in the magnetic toner, and r represents a weight average particle diameter (μm) of the magnetic toner.

21. The image forming apparatus according to claim 1, wherein a chainlike-mass control means that makes said chainlike masses of the magnetic toner on the developer carrying member slender, and said chainlike-mass control means is provided in a state of non-contact with said developer carrying member.

22. The image forming apparatus according to claim 18, wherein at least two chainlike-mass control means are provided opposingly to said developer carrying member.

23. The image forming apparatus according to claim 18, wherein at least two chainlike-mass control means formed of magnetic members are provided opposingly to said developer carrying member.

24. The image forming apparatus according to claim 18, wherein a chainlike-mass control means has an opposing electrode provided in a state of non-contact with the developer carrying member in order to apply an alternating electric field to the vicinity of the developer control member, and a power source that forms an alternating electric field between said electrode and said developer carrying member is provided.

* * * * *

UNITED STATES PATENT AND TRADEMARK OFFICE

CERTIFICATE OF CORRECTION

PATENT NO. : 5,464,720

DATED : November 7, 1995

INVENTOR(S) : YOSHINOBU BABA ET AL.

It is certified that error appears in the above-indentified patent and that said Letters Patent is hereby corrected as shown below:

COLUMN 3

Line 49, "magnet its," should read --magnet,--.

COLUMN 5

Line 67, "4x magnifications" should read --4X magnification--.

COLUMN 6

Line 1, "40,000x magnifications." should read --40,000X magnification.--.
Line 25, "of;" should read --of:--.
Line 65, "styfane" should read --styrene--.
Line 66, "styfane/methyl" should read --styrene/methyl-- and "styfane/ethyl" should read --styrene/ethyl--.

UNITED STATES PATENT AND TRADEMARK OFFICE

CERTIFICATE OF CORRECTION

PATENT NO. : 5,464,720

DATED : November 7, 1995

INVENTOR(S) : YOSHINOBU BABA ET AL.

It is certified that error appears in the above-indentified patent and that said Letters Patent is hereby corrected as shown below:

COLUMN 7

Line 1, "styfane" should read --styrene--
and "styfane/" should read --styrene/--.
Line 2, "styfane/ethyl" should read --styrene/ethyl--.
Line 5, "styfane" should read --styrene--.

COLUMN 10

Line 3, "Subsequently" should read --Subsequently,--.
Line 4, "Thus" should read --Thus,--.

COLUMN 11

Line 4, "preferably" should read --preferably be--.

COLUMN 12

Line 20, "agent 0.2% by weight" should be deleted.

UNITED STATES PATENT AND TRADEMARK OFFICE

CERTIFICATE OF CORRECTION

PATENT NO. : 5,464,720

DATED : November 7, 1995

INVENTOR(S) : YOSHINOBU BABA ET AL.

It is certified that error appears in the above-indentified patent and that said Letters Patent is hereby corrected as shown below:

COLUMN 14

Line 35, "μC/g" should read --μc/g--.

Signed and Sealed this

Twenty-third Day of April, 1996

Bruce Lehman

*Attest:*

BRUCE LEHMAN

*Attesting Officer*

*Commissioner of Patents and Trademarks*